US012584681B2

(12) United States Patent
Kökel et al.

(10) Patent No.: US 12,584,681 B2
(45) Date of Patent: Mar. 24, 2026

(54) COOLING DEVICE HAVING A HUMIDITY CONTROLLED CONTAINER

(71) Applicant: BSH Hausgeräte GmbH, Munich (DE)

(72) Inventors: Bilgehan Kökel, Tekirdag (AR); Yakup Oruc, Istanbul (AR); Özkan Dagci, Tekirdag (AR)

(73) Assignee: BSH Hausgeräte GmbH, Munich (DE)

( * ) Notice: Subject to any disclaimer, the term of this patent is extended or adjusted under 35 U.S.C. 154(b) by 75 days.

(21) Appl. No.: 18/701,287

(22) PCT Filed: Dec. 13, 2022

(86) PCT No.: PCT/EP2022/085547
§ 371 (c)(1),
(2) Date: Apr. 15, 2024

(87) PCT Pub. No.: WO2023/117574
PCT Pub. Date: Jun. 29, 2023

(65) Prior Publication Data

US 2024/0426543 A1 Dec. 26, 2024

(30) Foreign Application Priority Data

Dec. 23, 2021 (TR) ..... 2021/020751

(51) Int. Cl.
*F25D 23/06* (2006.01)
*F25D 25/02* (2006.01)

(52) U.S. Cl.
CPC ..... *F25D 23/062* (2013.01); *F25D 25/025* (2013.01)

(58) Field of Classification Search
CPC ..... F25D 2317/04131
See application file for complete search history.

(56) References Cited

U.S. PATENT DOCUMENTS 4,850,206 A * 7/1989 Larsen ..... F25D 25/025 62/382
7,624,593 B2 * 12/2009 Lee ..... F25D 25/021 62/408
8,201,570 B2 * 6/2012 Froelicher ..... A47L 15/4263 134/186
9,677,806 B2 6/2017 Bischofberger et al.
10,830,530 B2 * 11/2020 Alyanak ..... F25D 25/02
10,962,281 B2 * 3/2021 Lee ..... F25D 17/042
(Continued)

FOREIGN PATENT DOCUMENTS

CN 106322909 A 1/2017
CN 106322909 B * 8/2019 ..... F25D 25/025
(Continued)

*Primary Examiner* — Daniel J Rohrhoff
(74) *Attorney, Agent, or Firm* — Laurence A. Greenberg; Werner H. Stemer; Ralph E. Locher

(57) ABSTRACT

A cooling device includes a cabinet surrounding a storage compartment, at least one shelf provided in the storage compartment, a container which is provided at the shelf and includes a drawer for placing foodstuffs, and a cover. The cover is movable between a closed position in which the cover closes the drawer and an open position in which the cover and the drawer are at a distance from one another. A slider unit is configured to move the cover between the closed position and the open position. The slider unit is configured to be moved on the shelf in a width direction of the cooling device.

9 Claims, 14 Drawing Sheets

(56) References Cited

U.S. PATENT DOCUMENTS

| | | | | |
|---|---|---|---|---|
| 11,091,943 | B2 | 8/2021 | Ferreira et al. | |
| 11,754,335 | B2 * | 9/2023 | Li | F25D 25/025 312/404 |
| 2005/0172657 | A1 * | 8/2005 | Hwang | F25D 25/025 62/407 |
| 2012/0146477 | A1 * | 6/2012 | Bischofberger | F25D 25/025 312/404 |
| 2015/0300724 | A1 * | 10/2015 | Becke | F25D 23/028 312/405 |

FOREIGN PATENT DOCUMENTS

| | | | | |
|---|---|---|---|---|
| EP | 2473797 | A2 | 7/2012 | |
| EP | 2473797 | B1 * | 4/2019 | F25D 25/025 |
| EP | 3627082 | A1 | 3/2020 | |

* cited by examiner

COOLING DEVICE HAVING A HUMIDITY CONTROLLED CONTAINER

FIELD AND BACKGROUND OF THE INVENTION

The present invention relates to a cooling device including:

a cabinet surrounding a storage compartment;

at least one shelf provided in the storage compartment;

a container which is provided at the shelf and which includes a drawer (31) for placing foodstuffs and a cover, the cover is movable between a closed position in which the cover closes the drawer and an open position in which the cover and the drawer are at a distance from one another; and a slider unit configured to move the cover between the closed position and the open position, the slider unit is configured to be moved on the shelf in a width direction of the cooling device.

BACKGROUND OF THE INVENTION

Since different groceries require different levels of humidity in order to maintain their freshness to an optimum degree, it may be necessary as a function of the type of groceries accommodated in the container to conduct humidity out of the container to a greater or lesser degree. A moveable seal which is attached in a front face or a cover of the container is usually used here to control the release of humidity from the container, said seal, in an open position, allowing the escape of humid air out of the container into the surrounding storage compartment. In the state of the art, a container is disclosed wherein the container is humidity-controlled container by adjusting the opening degree of the cover by a slider unit.

A prior art publication in the technical field of the invention may be referred to as U.S. Pat. No. 11,091,943 (B2), which discloses a refrigeration device including a housing which surrounds a storage compartment; and a container mounted in the storage compartment and including a drawer and a cover, with the cover being height-adjustable between a closed position of the drawer and an open position. The cover is guided on an obliquely sloping path between the closed position and the open position by ramps adjacent to corners of the cover.

SUMMARY OF THE INVENTION

An object of the present invention is to provide a humidity-controlled container having an indicator configured to be moved smoothly according to the movement of a slider unit.

The present invention proposes a cooling device comprising a cabinet surrounding a storage compartment; at least one shelf provided in the storage compartment; a container provided at the shelf, which comprises a drawer for placing foodstuffs and a cover, wherein the cover is movable between a closed position in which the cover closes the drawer and an open position in which the cover and the drawer are at a distance from one another; a slider unit configured to move the cover between the closed position and the open position, wherein the slider unit is configured to be moved on the shelf in a width direction of the cooling device. The slider unit comprises at least two oblique guiding slots extending parallel to each other. The cooling device further comprises an indicator provided with at least two guiding ribs inserted into the respective oblique guiding slots. Thus, the indicator is moved smoothly according to the movement of the cover. Besides, the rotation of the indicator about its own axis of the indicator inside the oblique guiding slot is prevented when the indicator is moved.

The slider unit comprises a top slider provided on the shelf and configured to be moved in the width direction and a bottom slider connected to the top slider and configured to be moved with the top slider in the width direction. At least one portion of the top slider is moved on the shelf so as to be above the shelf. The bottom slider is moved on the shelf so as to be beneath the shelf. The bottom slider is connected to the cover. Therefore, the movement of the top slider is transmitted to the cover which is located beneath the shelf. Thus, adjusting the position of the cover is made easier for the user.

The top slider has a connection protrusion extending in a direction towards the bottom slider, wherein the bottom slider has a respective connection housing, and wherein the connection protrusion and the connection housing are sized and shaped to engage each other. Thus, the top slider and the bottom slider are moved together as a single unit.

The oblique guiding slots are provided at the bottom slider. Thus, the indicator is moved with the bottom slider.

The bottom slider is provided with an actuating means connected to the cover for moving the cover. Thus, the indicator and the cover are moved together by the bottom slider. Thus, the indicator is moved accordingly to the movement of the cover.

A guiding ramp is provided at both side edges of the shelf for guiding the movement of the cover. Thus, the cover is moved in a height-adjustable manner.

The indicator has at least three level indicating portions. These three level indicating portions may indicate the humidity level in the container. For example, the first level indicating portion may be "high humidity", the second level indicating portion may be "low humidity" and the third level indicating portion may be "mid humidity". Thus, humidity levels in the container are displayed.

The cover is provided with an oblique actuating slot wherein the actuating means is moved. An oblique actuating slot is provided on the top of the cover. The actuating means is inserted into the oblique actuating slot. The oblique actuating slot extends at an angle with respect to the width direction and the depth direction. Thus, when the slider unit is moved in the width direction, the cover is moved in a height adjustable manner.

In this document, "X-direction" corresponds to a width direction of the cooling device and the cabinet.

In this document, "Z-direction" corresponds to a depth direction of the cooling device and the cabinet.

BRIEF DESCRIPTION OF THE FIGURES

The accompanying drawings are given solely for the purpose of exemplifying the invention whose advantages over the prior art were outlined above and will be explained in detail hereinafter.

DETAILED DESCRIPTION OF THE INVENTION

Figure 1:
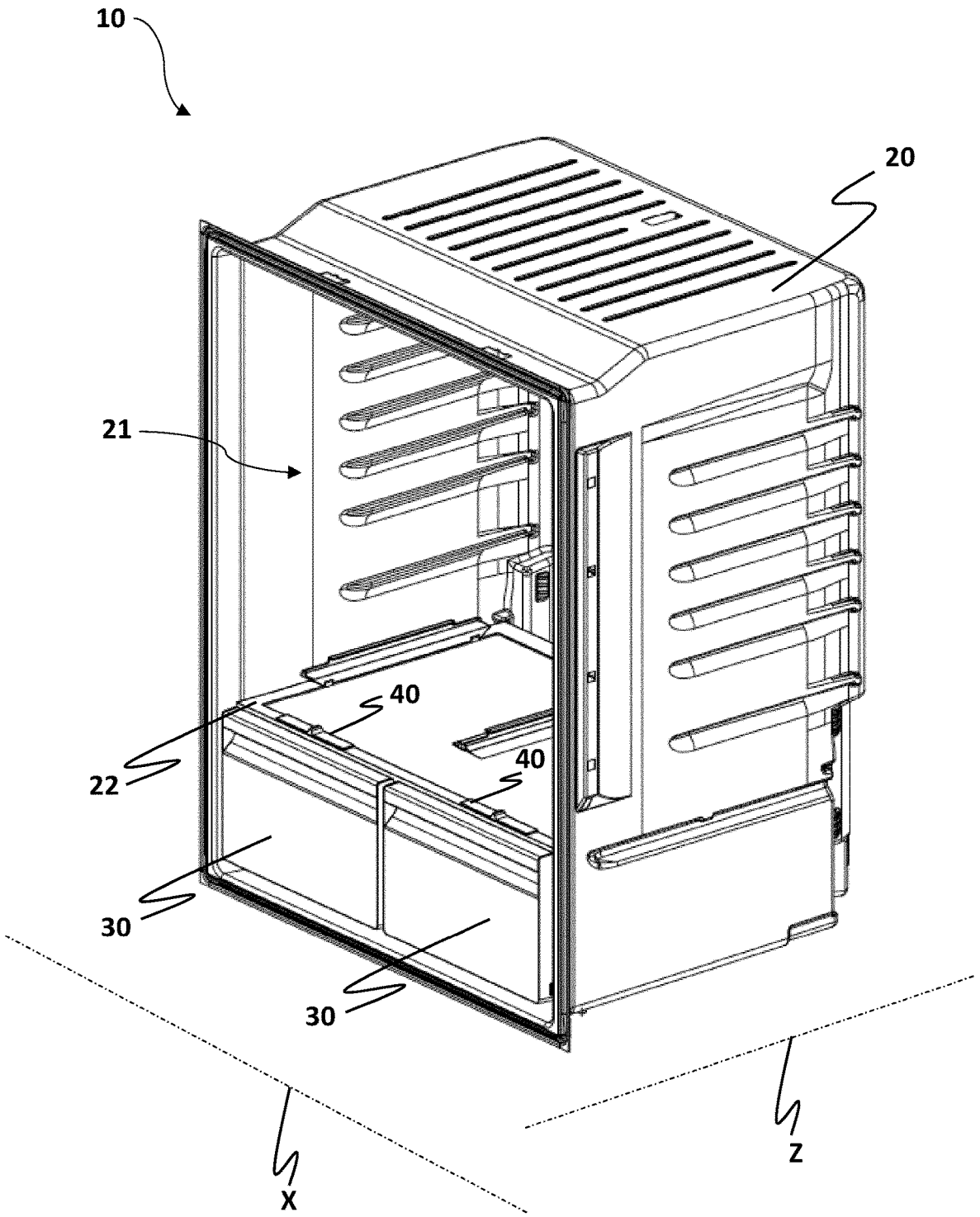
FIG. 1 is a perspective view of the cooling device having a container, according to the present invention.
Figure 2:
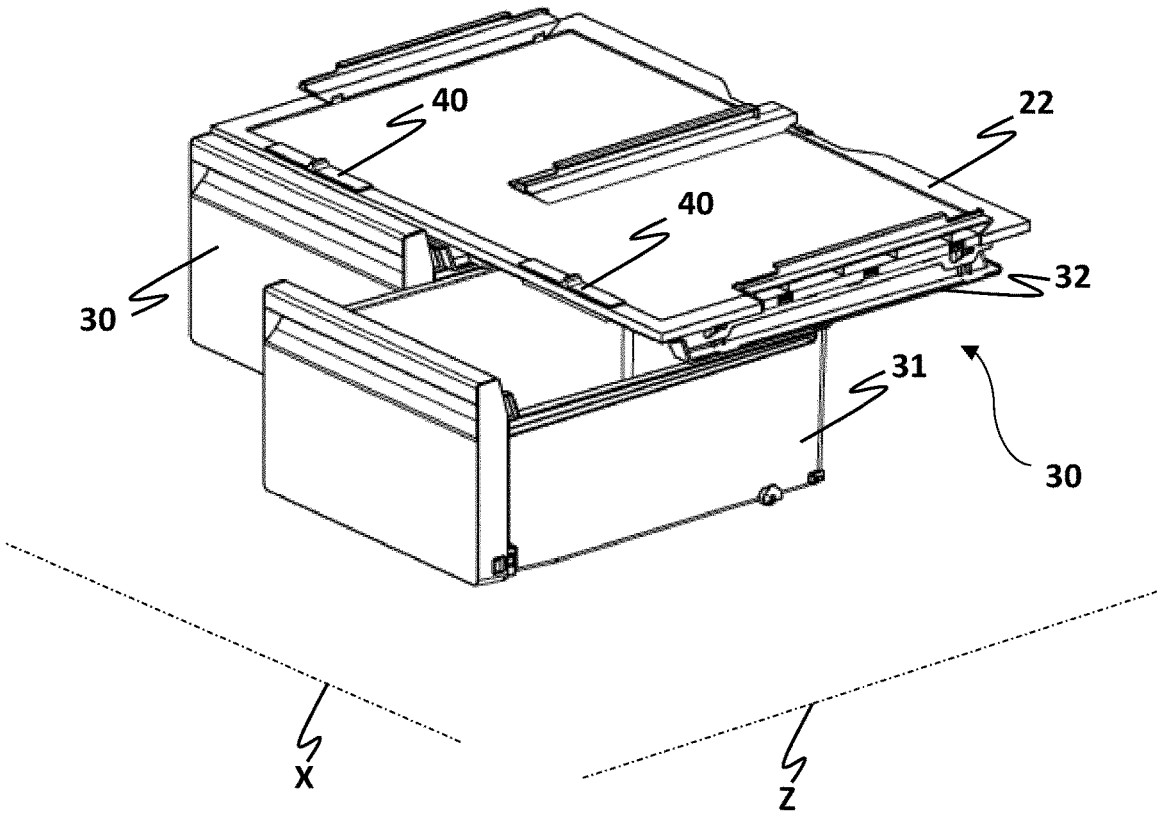
FIG. 2 is a perspective view of the shelf with a container, according to the present invention.
Figure 3:
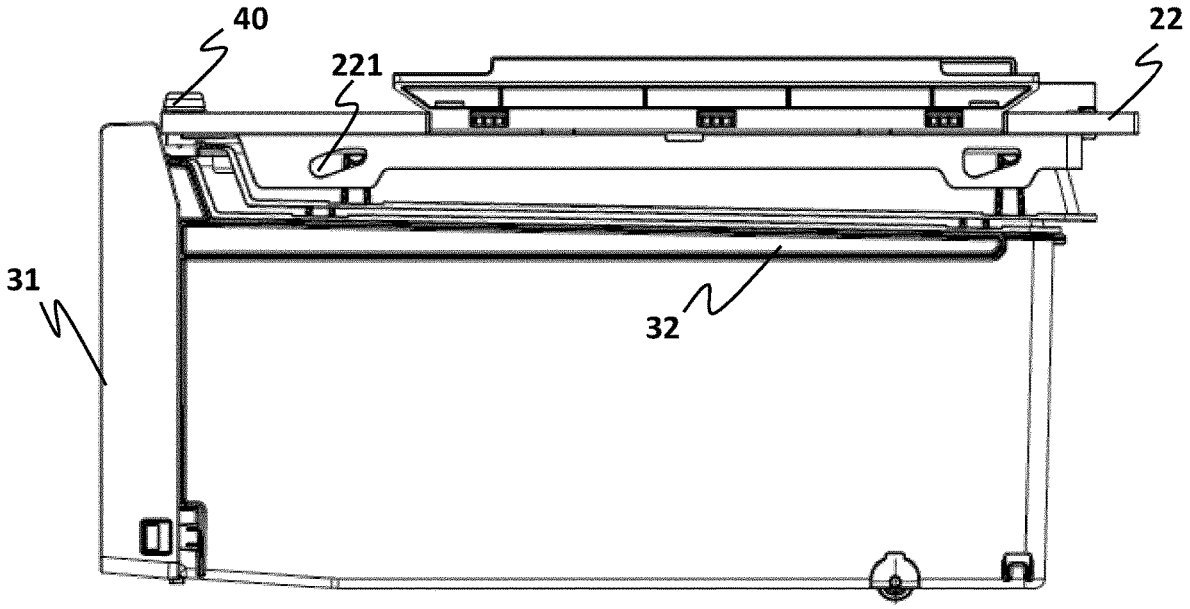
FIG. 3 is a side view of the shelf with a container, according to the present invention.
Figure 4:
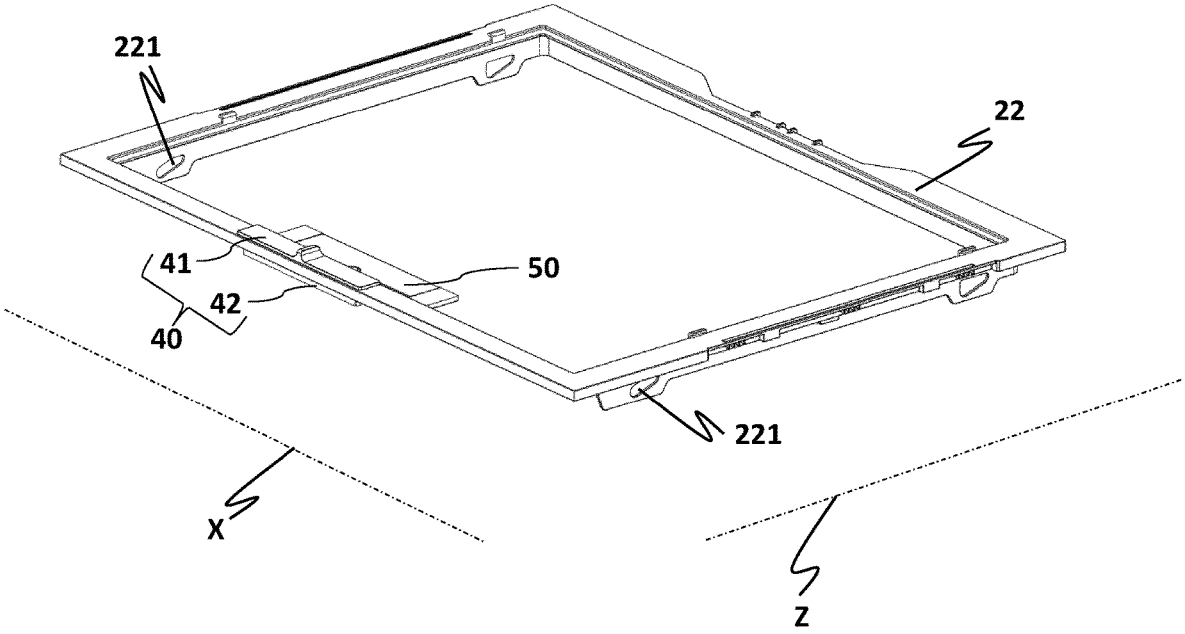
FIG. 4 is a perspective view of the shelf with the slider unit, according to the present invention.
Figure 9:
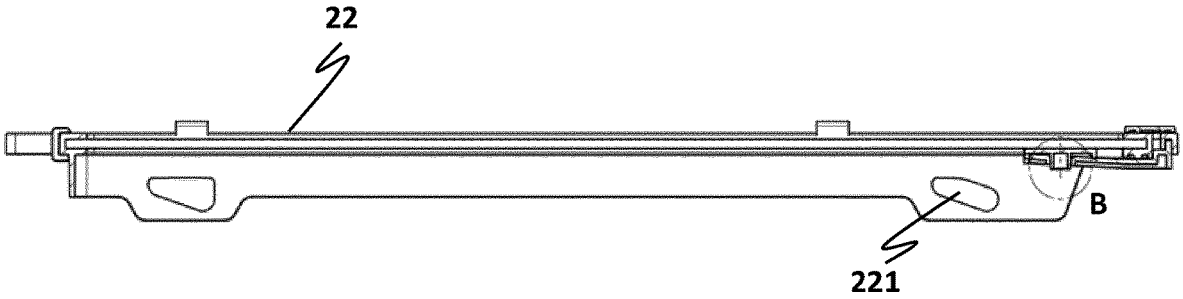
FIG. 9 is a side view of the shelf with the slider unit, according to the present invention.
Figure 10:
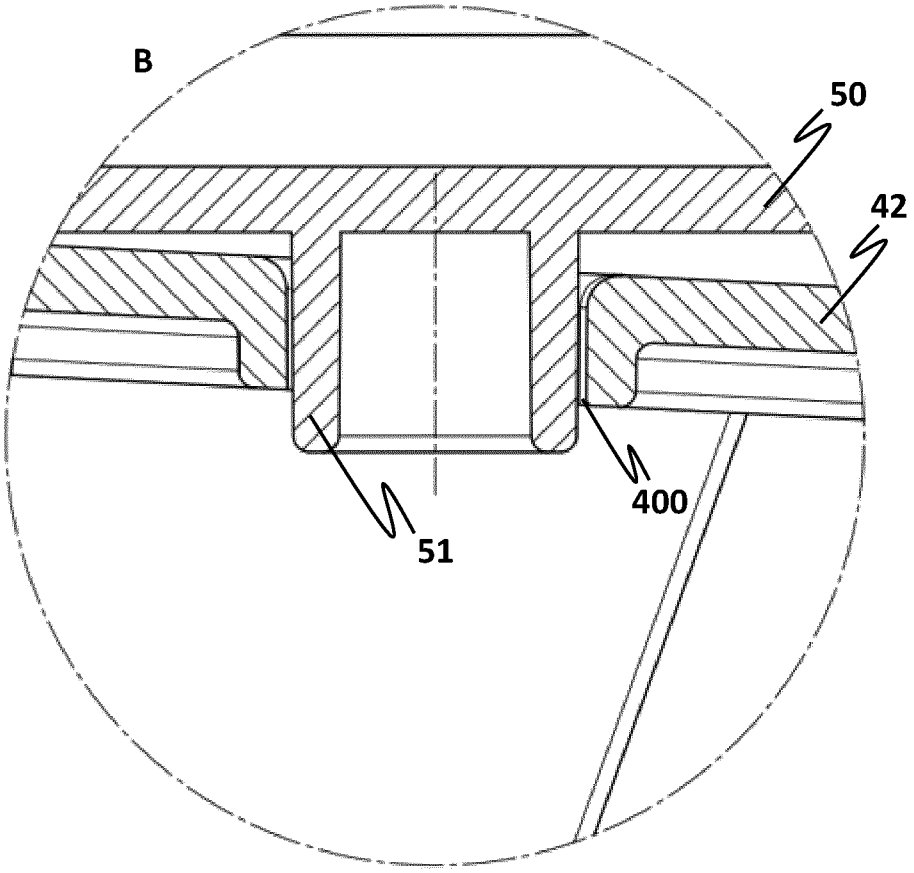
FIG. 10 is a detailed view of B of FIG. 9, according to the present invention.
Figure 11:
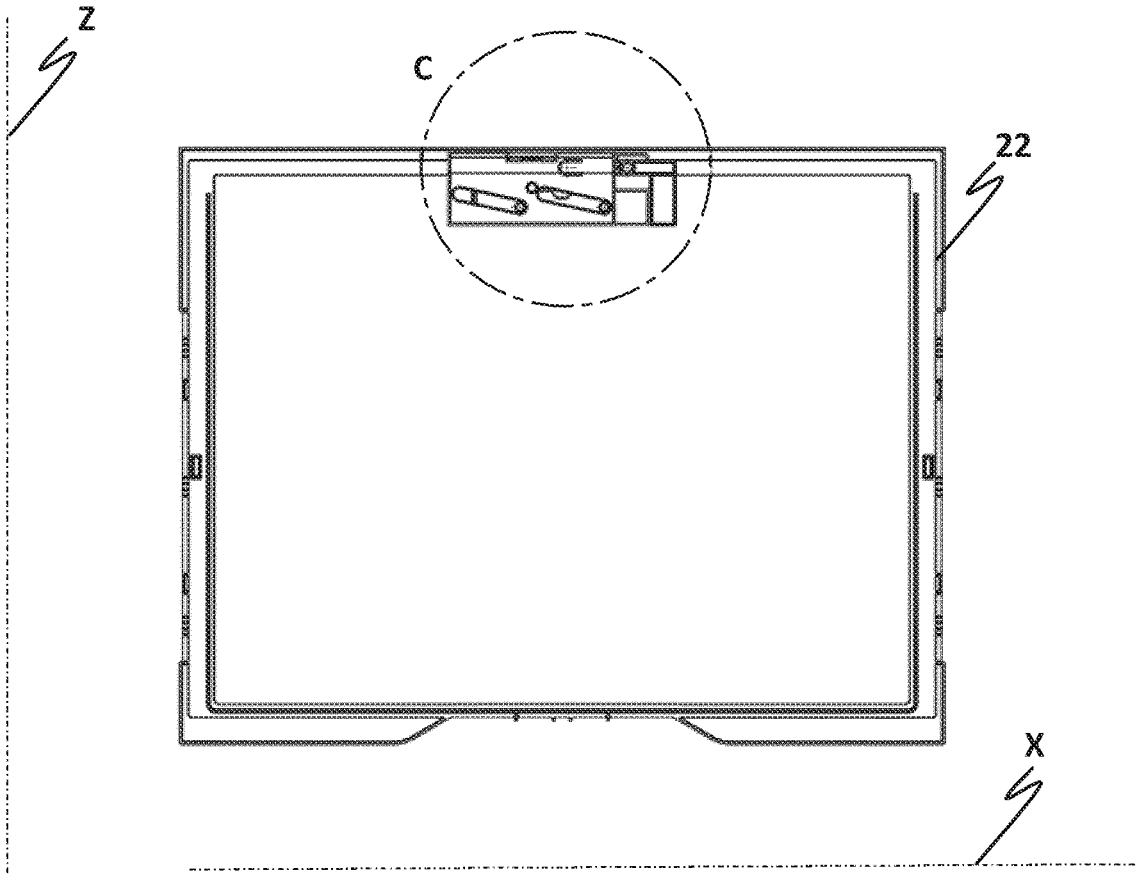
FIG. 11 is a bottom view of the shelf with the slider unit according to the present invention.
Figure 12:
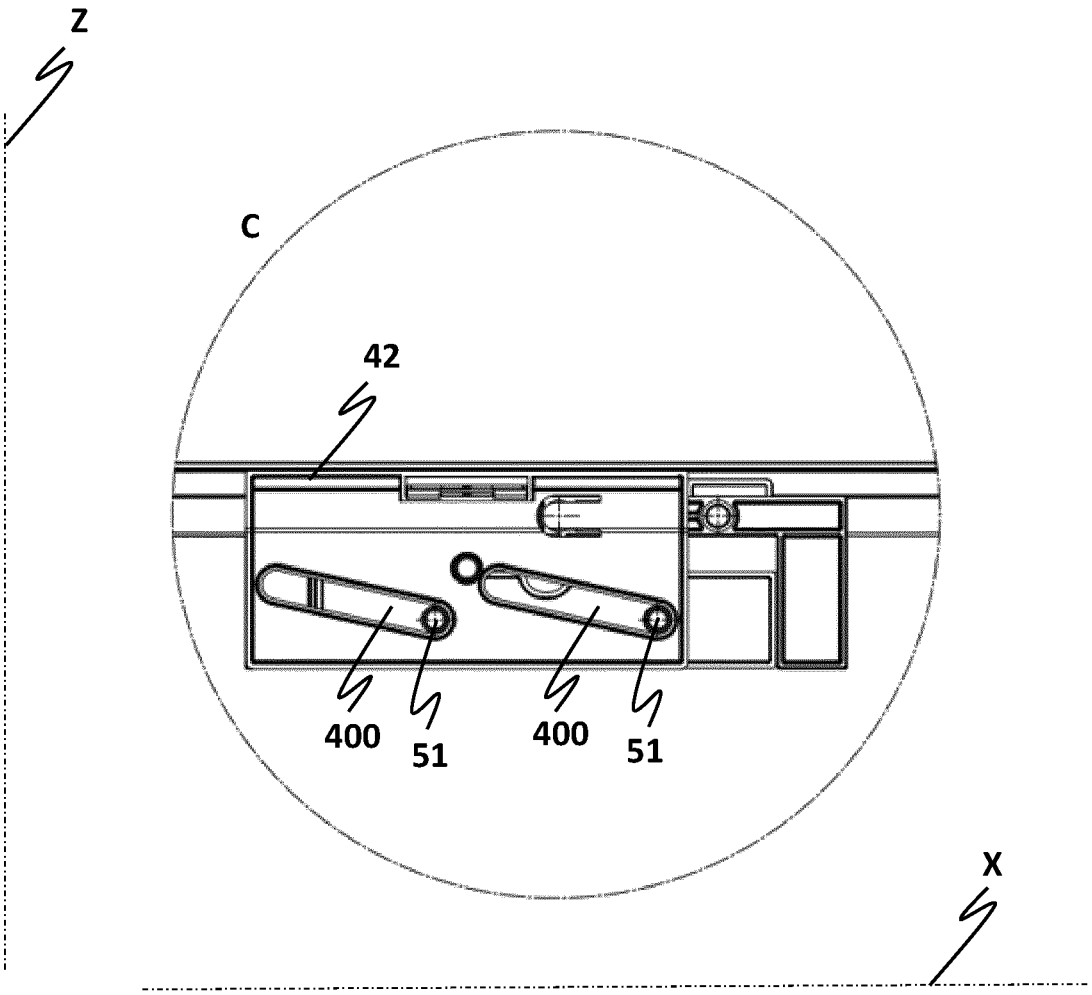
FIG. 12 is a detailed view of C of FIG. 11, according to the present invention.

The present invention proposes a cooling device (10) comprising a cabinet (20) surrounding a storage compartment (21). Referring to FIG. 1, at least one shelf (22) is provided in the storage compartment (21). Referring to FIG. 2, a container (30) is provided at the shelf (22). The container (30) comprises a drawer (31) for placing a foodstuff and a cover (32). As can be seen in FIG. 2, the drawer (31) is movable in a dept direction (Z). The depth direction (Z) of the cooling device (10) is shown in FIGS. 1 and 2. The cover (32) is movable between a closed position in which the cover (32) closes the drawer (31) and an open position in which the cover (32) and the drawer (31) are at a distance from one another. Referring to FIG. 3, the cover (32) is at the closed position. A slider unit (40) is configured to move the cover (32) between the closed position and the open position, wherein the slider unit (40) is configured to be moved on the shelf (22) in a width direction (X) of the cooling device (10). The width direction (X) of the cooling device (10) is parallel to the horizontal direction of the cooling device (10). The depth direction (Z) is perpendicular to the width direction (X). The slider unit (40) is connected to the cover (32). The cover (32) is a height adjustable cover. The cover (32) is moved by moving the slider unit (40) in the width direction (X) of the cooling device (10). The slider unit (40) comprises at least two oblique guiding slots (400) extending parallel to each other. Two oblique guiding slots (400) are provided on the slider unit (40) so as to be spaced apart from each other with respect to the width direction (X). Two oblique guiding slots (400) are provided on the slider unit (40) so as to be aligned with each other with respect to the depth direction (Z). Referring to FIGS. 9 and 10, the cooling device (10) further comprises an indicator (50) provided with at least two guiding ribs (51) inserted into the respective oblique guiding slots (400). The indicator (50) indicates the position of the cover (32). Therefore, the indicator (50) indicates the humidity level in the drawer (31). The indicator (50) is moved by slider unit (40) since guiding ribs (51) are inserted into the respective oblique guiding slots (400). As can be seen in FIGS. 11 and 12, two oblique guiding slots (400) extend parallel to each other in such a way that the oblique guiding slots (400) extend at an angle with respect to the width direction (X) and the depth direction (Z) of the cooling device (10). Thus, the indicator (50) is moved in the depth direction when the slider unit (40) is moved in the width direction (X) by the user. Since the indicator (50) is moved by two oblique guiding slots (400), the indicator (50) is moved smoothly according to the movement of the slider unit (40). In one embodiment of the present invention, the indicator (50) has at least two level-indicating portions (52). When the cover (32) is at the closed position, the indicator (50) is at a first position. When the cover (32) is at the open position, the indicator (50) is at a second position. When the cover (32) is moved from the closed position to the open position by the slider unit (40), the indicator (50) is moved from the first position to the second position by the slider unit (40) accordingly to the movement of the cover (32).

Figure 5:
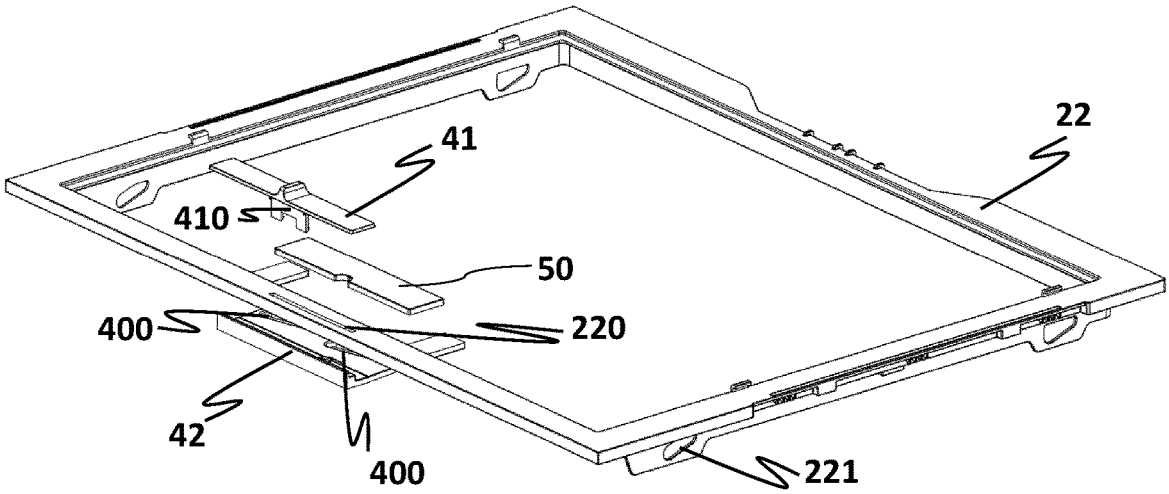
FIG. 5 is an exploded view of the shelf with the slider unit, according to the present invention.

Referring to FIG. 5, the slider unit (40) comprises a top slider (41) provided on the shelf (22) and configured to be moved in the width direction (X) and a bottom slider (42) connected to the top slider (41) and configured to be moved with the top slider (41) in the width direction (X). The top slider (41) is provided at the shelf (22) so as to be above the shelf (22). The bottom slider (42) is provided at the shelf (22) so as to be beneath the shelf (22). The bottom slider (42) is connected to the cover (32) and the top slider (41). Thus, the cover (32) is moved when the top slider (41) is moved by the user.

Figure 7:
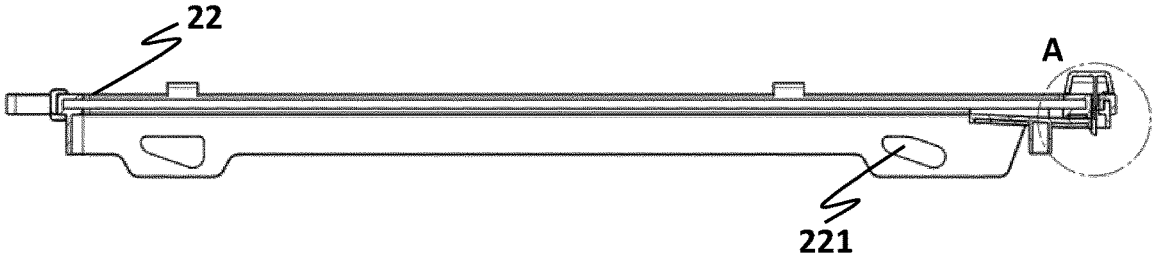
FIG. 7 is a side view of the shelf with the slider unit, according to the present invention.
Figure 8:
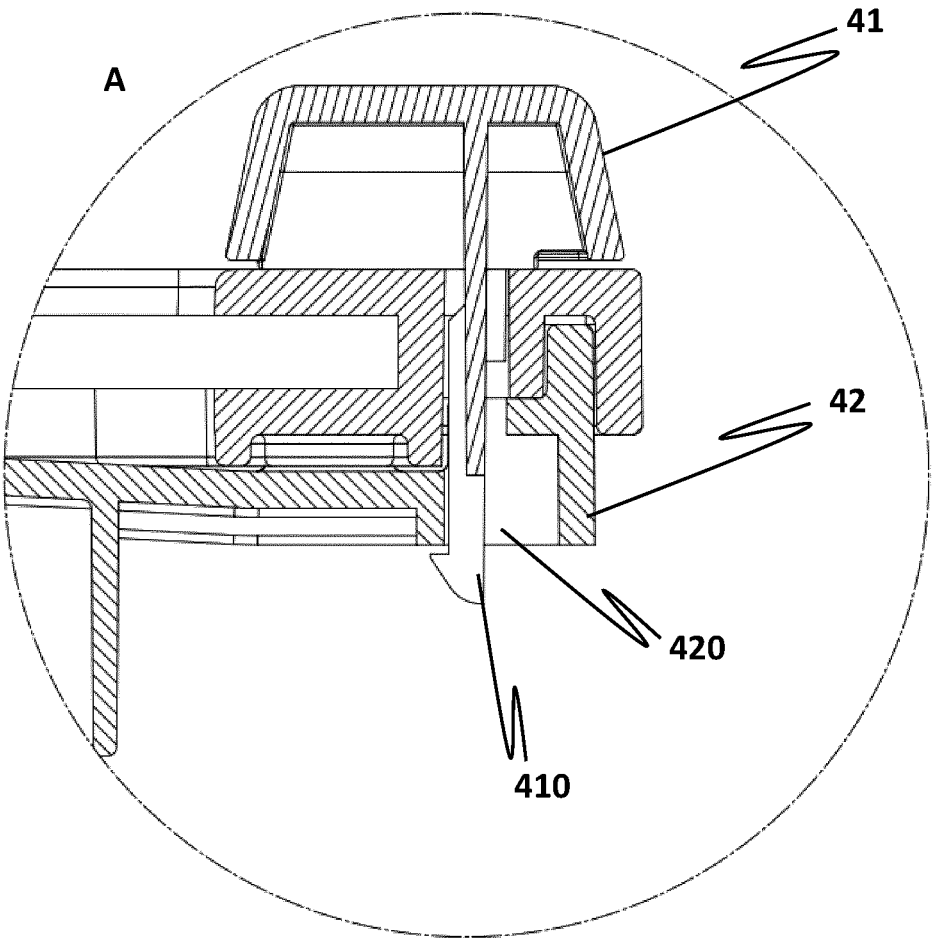
FIG. 8 is a detailed view of A of FIG. 7, according to the present invention.

Referring to FIGS. 7 and 8, the top slider (41) has a connection protrusion (410) extending in a direction towards the bottom slider (42), wherein the bottom slider (42) has a respective connection housing (420), and wherein the connection protrusion (410) and the connection housing (420) are sized and shaped to engage each other. As can be seen in FIG. 8, the connection protrusion (410) has a portion in the form of a hook. Thus, the top slider (41) is connected to the bottom slider (42) firmly.

Referring to FIG. 12, the oblique guiding slots (400) are provided at the bottom slider (42). The indicator (50) is connected to the bottom slider (42) so as to be beneath the shelf (22). The shelf (22) is a glass shelf which is made from a glass-ceramic material. Thus, the indicator (50) becomes visible.

Figure 6:
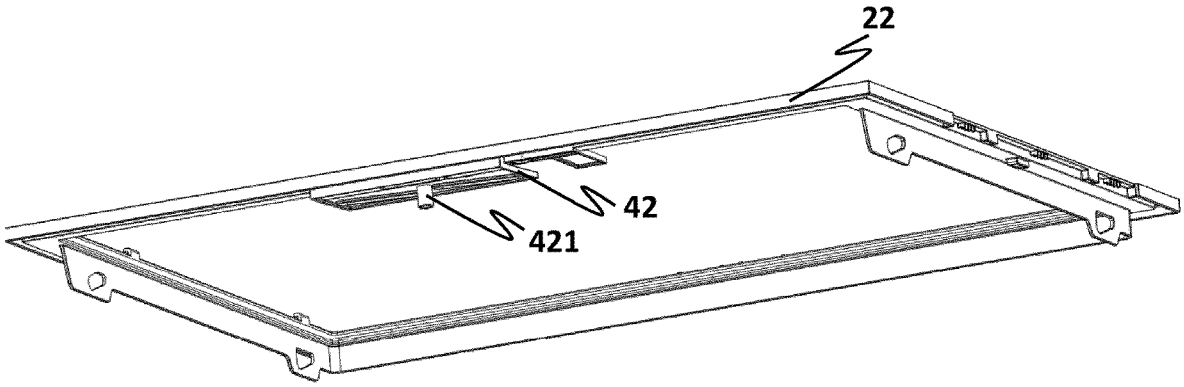
FIG. 6 is another perspective view of the shelf with the slider unit, according to the present invention.

Referring to FIG. 6, the bottom slider (42) is provided with an actuating means (421) connected to the cover (32) for moving the cover (32). The actuating means (421) is in the form of a protrusion extending from the bottom slider (42) to the cover (32). When the bottom slider (42) is moved in the width direction (X), the actuating means (421) moves the cover (32) between the closed position and the open position.

Referring to FIG. 5, the shelf (22) is provided with a sliding slot (220) extending in the width direction (X) wherein the connection protrusion (410) is moved. The connection protrusion (410) is connected to the bottom slider (42) by passing through the sliding slot (220). The sliding slot (220) guides the movement of the top slider (41). As can be seen in FIG. 5, the sliding slot (220) is provided on the front edge of the shelf (22). Thus, moving the slider unit (40) is made easier.

Referring to FIGS. 11 and 12, two oblique guiding slots (400) are identical. The length and width of the oblique guiding slots (400) are the same. Thus, the indicator (50) is moved smoothly according to the movement of the slider unit (40).

Referring to FIG. 3, a guiding ramp (221) is provided at both side edges of the shelf (22) for guiding the movement of the cover (32). The cover (32) has two projections which are inserted into the respective guiding ramp (221). The movement of the projections is guided by the guiding ramp (221). The guiding ramp (221) has an inclined portion. When the cover (32) is at the open position, the projections of the cover (32) are at the highest portion of the guiding ramp (221). When the cover (32) is at the closed position, the projections of the cover (32) are at the deepest portion of the guiding ramp (221).

Figure 13:
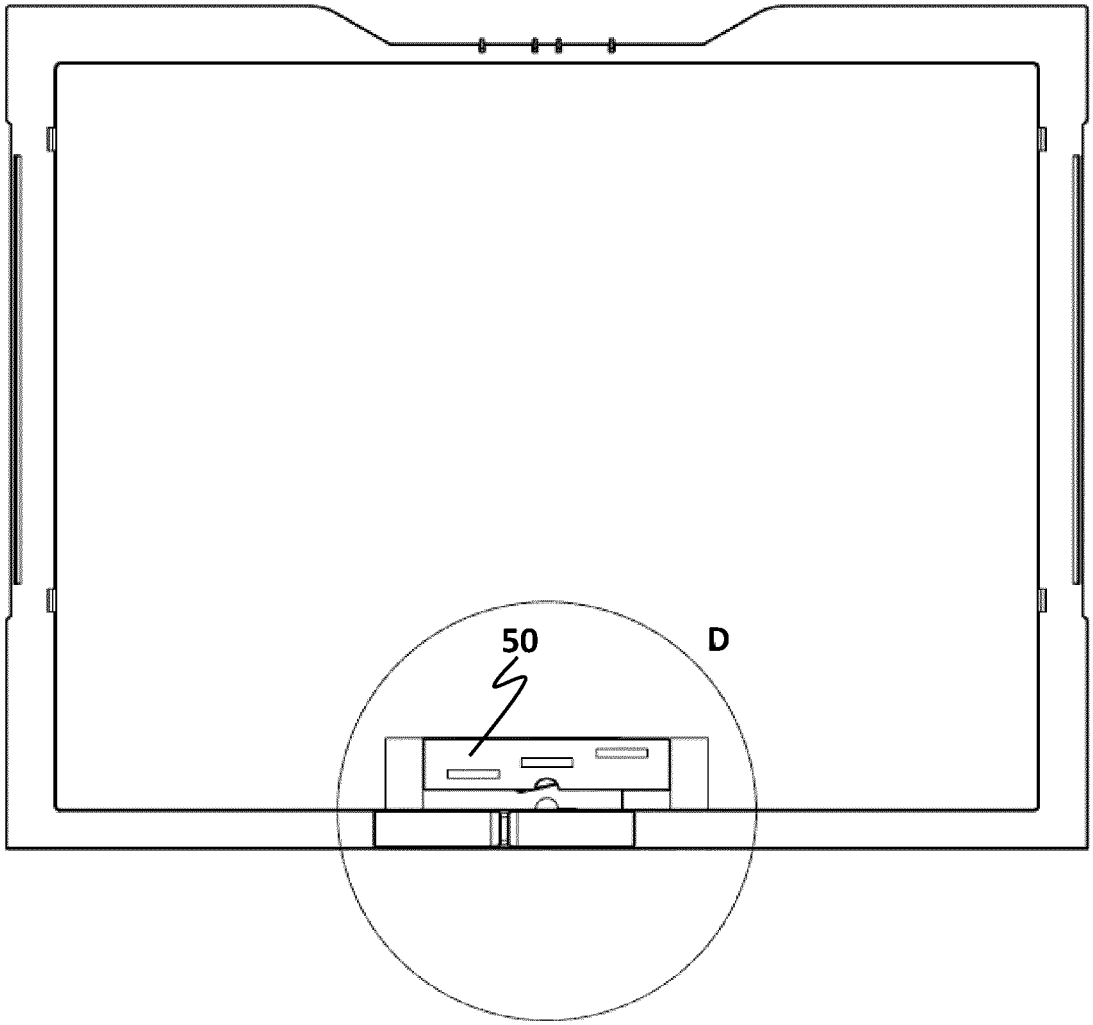
FIG. 13 is a top view of the shelf with the slider unit according to the present invention.
Figure 14:
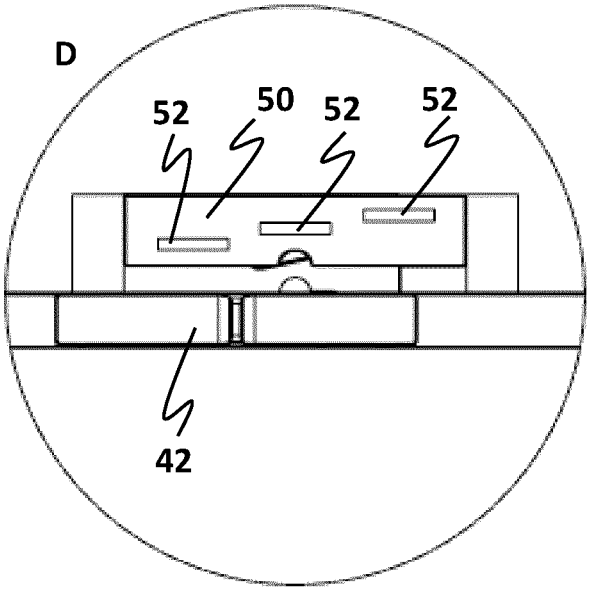
FIG. 14 is a detailed view of D of FIG. 13, according to the present invention.

Referring to FIGS. 13 and 14, the indicator (50) has at least three level indicating portions (52). The cover (32) has a further stable position which is between the open position and the closed position. The first level indicating portion corresponds to the open position of the cover, the second level indicating portion corresponds to the closed position of the cover and the third level indicating portion corresponds to the stable position which is between the open position and the closed position. These level indicating portions (52) are used for indicating the humidity level inside the drawer (31).

REFERENCE LIST

10. Cooling device
20. Cabinet
  21. Storage compartment
  22. Shelf
    220. Sliding slot
    221. Guiding ramp
30. Container
  31. Drawer
  32. Cover
40. Slider unit
  400. Oblique guiding slot
  41. Top slider
    410. Connection protrusion
  42. Bottom slider
    420. Connection housing
    421. Actuating means
50. Indicator
  51. Guiding rib
  52. Level indicating portions
X. Width direction
Z. Depth direction

The invention claimed is:

1. A cooling device, comprising:

a storage compartment;

a cabinet surrounding said storage compartment;

at least one shelf disposed in said storage compartment;

a container disposed at said at least one shelf, said container including a drawer for placing foodstuffs and a cover, said cover being movable between a closed position and an open position, said cover closing said drawer in said closed position and said cover and said drawer being at a distance from one another in said open position;

a slider unit configured to move said cover between said closed position and said open position, said slider unit configured to be moved on said at least one shelf in a width direction of the cooling device, and said slider unit including at least two oblique guiding slots extending parallel to each other;

said slider unit including a top slider disposed on said at least one shelf and configured to be moved in the width direction and a bottom slider connected to said top slider and configured to be moved with said top slider in the width direction; and an indicator having at least two guiding ribs each inserted into a respective one of said oblique guiding slots.

2. The cooling device according to claim 1, wherein said top slider has a connection protrusion extending in a direction towards said bottom slider, said bottom slider has a connection housing, and said connection protrusion and said connection housing are sized and shaped to engage each other.

3. The cooling device according to claim 2, wherein said at least one shelf has a sliding slot extending in the width direction, and said connection protrusion is movable in said sliding slot.

4. The cooling device according to claim 1, wherein said at least two oblique guiding slots are disposed at said bottom slider.

5. The cooling device according to claim 1, wherein said bottom slider has an actuator connected to said cover for moving said cover.

6. The cooling device according to claim 5, wherein said actuator is movable in an oblique actuating slot of said cover.

7. The cooling device according to claim 1, wherein said at least two oblique guiding slots are identical.

8. The cooling device according to claim 1, wherein said at least one shelf has side edges, and guiding ramps are each disposed at a respective one of said side edges of said shelf for guiding the movement of said cover.

9. The cooling device according to claim 1, wherein said indicator has at least three level indicating portions.

* * * * *